US011854727B2

(12) United States Patent
Uchikawa

(10) Patent No.: US 11,854,727 B2
(45) Date of Patent: Dec. 26, 2023

(54) POWDER MAGNETIC CORE WITH TERMINAL AND METHOD FOR MANUFACTURING THE SAME

(71) Applicant: PROTERIAL, LTD., Tokyo (JP)

(72) Inventor: Akio Uchikawa, Minato-ku (JP)

(73) Assignee: PROTERIAL, LTD., Tokyo (JP)

( * ) Notice: Subject to any disclaimer, the term of this patent is extended or adjusted under 35 U.S.C. 154(b) by 889 days.

(21) Appl. No.: 16/496,125

(22) PCT Filed: Mar. 23, 2018

(86) PCT No.: PCT/JP2018/011860
§ 371 (c)(1),
(2) Date: Sep. 20, 2019

(87) PCT Pub. No.: WO2018/174268
PCT Pub. Date: Sep. 27, 2018

(65) Prior Publication Data

US 2020/0098505 A1 Mar. 26, 2020

(30) Foreign Application Priority Data

Mar. 24, 2017 (JP) ..... 2017-059694

(51) Int. Cl.
*H01F 27/28* (2006.01)
*H01F 1/24* (2006.01)
(Continued)

(52) U.S. Cl.
CPC ..... *H01F 1/24* (2013.01); *H01F 1/147* (2013.01); *H01F 27/255* (2013.01); *H01F 27/29* (2013.01); *H01F 41/0246* (2013.01)

(58) Field of Classification Search
CPC ..... H01F 27/255; H01F 1/147; H01F 27/29; H01F 41/0246; H01F 17/045; H01F 1/26;
(Continued)

(56) References Cited

U.S. PATENT DOCUMENTS

2015/0380149 A1* 12/2015 Nakamura ..... H01F 41/0206 427/127
2016/0336104 A1* 11/2016 Noguchi ..... C22C 33/0257
(Continued)

FOREIGN PATENT DOCUMENTS

CN 102314995 A 1/2012
JP 60-25114 U 2/1985
(Continued)

OTHER PUBLICATIONS

Office Action dated Mar. 10, 2022 issued by the State Intellectual Property Office of People's Republic of China in Chinese Application No. 201880020297.4.
(Continued)

*Primary Examiner* — Shawki S Ismail
*Assistant Examiner* — Kazi S Hossain
(74) *Attorney, Agent, or Firm* — Sughrue Mion, PLLC

(57) ABSTRACT

A powder magnetic core with terminal includes: a powder magnetic core composed of Fe-based alloy particles including Fe and an element M (M is Cr and/or Al) which is more easily oxidizable than Fe; and at least two terminals formed at an interval on a surface of the powder magnetic core. The powder magnetic core includes the Fe-based alloy particles, and an underlayer including the element M (M is Cr and/or Al), Fe and O formed on a surface of the Fe-based alloy particles. A first layer including at least one of Cr or Al and O is formed on a surface including a region in which the terminals of the powder magnetic core are formed. The terminals are formed on a surface of the first layer. Each of the terminals includes a second layer including one of Au, Ag, Cu, Ti or Cr.

11 Claims, 2 Drawing Sheets

(51) Int. Cl.

| | |
|---|---|
| ***H01F 27/255*** | (2006.01) |
| ***H01F 41/02*** | (2006.01) |
| ***H01F 1/147*** | (2006.01) |
| ***H01F 27/29*** | (2006.01) |

(58) Field of Classification Search

CPC .. H01F 27/292; H01F 1/24; B22F 3/24; B22F 5/10; B22F 2998/10; B22F 2999/00; C22C 38/02; C22C 2202/02; C22C 38/06; C22C 38/18

USPC ..... 336/192, 200, 232

See application file for complete search history.

(56) References Cited

U.S. PATENT DOCUMENTS

| | | | | |
|---|---|---|---|---|
| 2017/0025214 | A1* | 1/2017 | Nishimura | C22C 38/002 |
| 2018/0308609 | A1* | 10/2018 | Shinohara | H01F 17/0013 |

FOREIGN PATENT DOCUMENTS

| | | | | |
|---|---|---|---|---|
| JP | 2004-235428 | A | | 8/2004 |
| JP | 2011091281 | A | * | 5/2011 |
| JP | 2012-9548 | A | | 1/2012 |
| JP | 2013-254917 | A | | 12/2013 |
| JP | 2016-27643 | A | | 2/2016 |
| JP | 2016027643 | A | * | 2/2016 |

OTHER PUBLICATIONS

International Preliminary Report on Patentability and Written Opinion dated Oct. 3, 2019 from the International Bureau in counterpart International Application No. PCT/JP2018/011860.

Office Action issued in Japanese Patent Application No. 2019-507035 dated Aug. 27, 2019.

International Search Report for PCT/JP2018/011860 dated Jun. 19, 2018 [PCT/ISA/210].

Communication dated Sep. 15, 2020, from the European Patent Office in European Application No. 18771675.8.

Office Action dated Sep. 15, 2022 in Chinese Application No. 201880020297.4.

Chinese Office Action dated Jan. 9, 2023 in Chinese Application No. 201880020297.4.

* cited by examiner

Total Magnification : X300000

POWDER MAGNETIC CORE WITH TERMINAL AND METHOD FOR MANUFACTURING THE SAME

CROSS REFERENCE TO RELATED APPLICATIONS

This application is a National Stage of International Application No. PCT/JP2018/011860 filed Mar. 23, 2018, claiming priority based on Japanese Patent Application No. 2017-059694 filed Mar. 24, 2017.

TECHNICAL FIELD

The present invention relates to a powder magnetic core with terminal which includes a terminal composed of a multilayer electrode film, formed on the surface of the powder magnetic core, and uses a metallic magnetic material of an Fe-based alloy, and a method for manufacturing the same.

BACKGROUND ART

As a surface mount type coil component constituting an inductance element such as a transformer or a choke coil used in various electronic devices, cores using powders of soft ferrite materials such as Mn-based ferrite and Ni-based ferrite, and metallic magnetic materials such as Fe-based amorphous or pure iron, an Fe—Si-based alloy, an Fe—Ni-based alloy, an Fe—Si—Cr-based alloy, an Fe—Si—Al-based alloy, and an Fe—Al—Cr-based alloys are widely used. For example, in a coil component using a drum-shaped ferrite magnetic core (drum core) having a body portion between flange portions formed at both ends in an axial direction, an insulation-coated conducting wire is wound around the body portion. The coil component is fixed to a terminal including a winding wire end portion formed on the flange portion by soldering and the like.

For example, Patent Document 1 discloses a coil component constituted by a core using a soft ferrite material. An electrode structure of a ferrite magnetic core has been proposed. In the electrode structure, an insulating film composed of $SiO_2$ and the like is formed on the surface of a flange portion of the ferrite magnetic core by sputtering, and a conductive coating film or a conductive sputtering film electrode is deposited on the insulating film to form a terminal. The insulating film is provided between the ferrite magnetic core and the terminal because of the insulation problem of the ferrite magnetic core.

The soft ferrite material has an excellent degree of freedom of a core shape and price. Meanwhile, the demand for coil components which can be used also for large currents in a high-temperature environment exceeding 130° C. increases, and the adoption of a core using a metallic soft magnetic material having a high Curie temperature and a large saturation magnetic flux density also progresses.

For example, Patent Document 2 proposes that an Fe-based alloy (Fe—Al—Cr-based alloy) powder is compression-molded, and each of particles is oxidized at high temperature in the state of a green compact to bond the particles with oxides formed on the surface as a grain boundary phase, and to cover the surface of the powder magnetic core with a thin film of the oxide. Furthermore, Patent Document 2 describes that a conductor film is directly formed as a terminal on the surface of the powder magnetic core by a sputtering method, an ion plating method, a printing method using a conductor paste, a transfer method, or a dip method and the like.

PRIOR ART DOCUMENTS

Patent Document

Patent Document 1: JP-Y-60-25114
Patent Document 2: JP-A-2016-27643

SUMMARY OF THE INVENTION

Problems to be Solved by the Invention

A metallic magnetic powder generally has lower electrical resistivity than that of the soft ferrite material. The resistance of the core described in Patent Document 2 is increased by covering a portion between the Fe-based alloy particles and the surface of the powder magnetic core with the oxide. If the thickness of the oxide is increased, the resistance can be further increased, but the thickness of the grain boundary phase is also increased. Since the grain boundary phase also functions as a magnetic gap, the increased film thickness of the oxide on the surface is apt to have an influence on magnetic properties, for example, relative lowering of magnetic permeability.

If the film thickness of the oxide formed on the surface of the powder magnetic core is increased by elevating a heat treatment temperature, pure iron is formed in the film as the heat treatment temperature is increased, which may inhibit high resistance. The upper limit of the film thickness of the oxide on the surface of the core formed by the heat treatment is about 100 nm, which may cause insufficient insulation between a plurality of terminals formed directly on the surface of the core.

In Patent Document 2, Au, Ag, Cu, Ti, Al, Ni, a Cu—Cr alloy, an Au—Ni—Cr alloy, a Ni—Cr alloy, or a Ni—Cu alloy are exemplified as the metal of the conductor film directly formed on the surface of the powder magnetic core. However, the adhesion of the conductor film is not sufficiently obtained, which may cause an insufficient adhesion strength of the terminal composed of the conductor film.

Therefore, it is an object of the present invention to provide a powder magnetic core with terminal using a metallic magnetic material of an Fe-based alloy, which has improved insulation between terminals and an increased terminal adhesion strength, and a method for manufacturing the same.

Means for Solving the Problems

According to a first aspect of the present invention, there is provided a powder magnetic core with terminal including: a powder magnetic core composed of Fe-based alloy particles including Fe and an element M (M is at least one of Cr or Al) which is more easily oxidizable than Fe; and at least two terminals formed at an interval on a surface of the powder magnetic core, wherein: the powder magnetic core includes the Fe-based alloy particles, and an underlayer including the element M (M is at least one of Cr or Al), Fe and O formed on a surface of the Fe-based alloy particles; a first layer including at least one of Cr or Al and O is formed on a surface including a region in which the terminals of the powder magnetic core are formed; the terminals are formed on a surface of the first layer; and each of the terminals includes a second layer including one of Au, Ag, Cu, Ti or Cr.

In the present invention, it is preferable that the terminal further includes a third layer including one of Ni, Au, Ag or Sn formed on a surface of the second layer.

In the present invention, it is preferable that a thickness tu of the underlayer, a thickness t1 of the first layer, and a thickness t2 of the second layer have a relationship of $tu<t1<t2$.

In the present invention, it is preferable that the first layer is composed of a Cr oxide or an Al oxide.

In the present invention, it is preferable that the Fe-based alloy includes Fe, Al and Cr; the underlayer includes Fe, Al, Cr and O; and the first layer includes Al or Cr and O.

In the present invention, it is preferable that two terminals are formed side by side on one surface of the powder magnetic core; and the underlayer is formed on the entire one surface of the powder magnetic core including at least between the terminals.

According to a second aspect of the present invention, there is provided a method for manufacturing a powder magnetic core with terminal, the powder magnetic core with terminal including: a powder magnetic core composed of Fe-based alloy particles including Fe and an element M (M is at least one of Cr or Al) which is more easily oxidizable than Fe; and at least two terminals formed at an interval on a surface of the powder magnetic core, the method including: producing the powder magnetic core including an underlayer formed on a surface of the Fe-based alloy particles, the underlayer including the element M (M is at least one of Cr or Al), and Fe and O; forming a first layer including at least one of Cr or Al and O on a surface including a region in which the terminals of the powder magnetic core are formed; and forming a second layer including one of Au, Ag, Cu, Ti, Fe or Cr on a surface of the first layer, wherein the first layer and the second layer are each formed by a sputtering method or a vapor deposition method.

In the present invention, it is preferable that the method further includes forming a third layer including one of Ni, Au, Ag or Sn on a surface of the second layer.

In the present invention, it is preferable that the first layer is composed of a Cr oxide or an Al oxide.

In the present invention, it is preferable that the method further includes: pressing a mixed powder including the Fe-based alloy particles into a predetermined shape to obtain a green compact; and heat-treating the green compact obtained by the pressing in an oxygen-containing atmosphere to oxidize the Fe-based alloy particles at high temperature, thereby forming the underlayer on the surface of the Fe-based alloy particles.

In the present invention, it is preferable that a thickness of the underlayer is 50 nm or more and 100 nm or less; a thickness of the first layer is more than 50 nm; and a total thickness of the underlayer and the first layer is 150 nm or more.

Effect of the Invention

The present invention can provide a powder magnetic core with terminal using a metallic magnetic material of an Fe-based alloy, which has improved insulation between terminals and an increased terminal adhesion strength, and a method for manufacturing the same.

MODE FOR CARRYING OUT THE INVENTION

Figure 1:
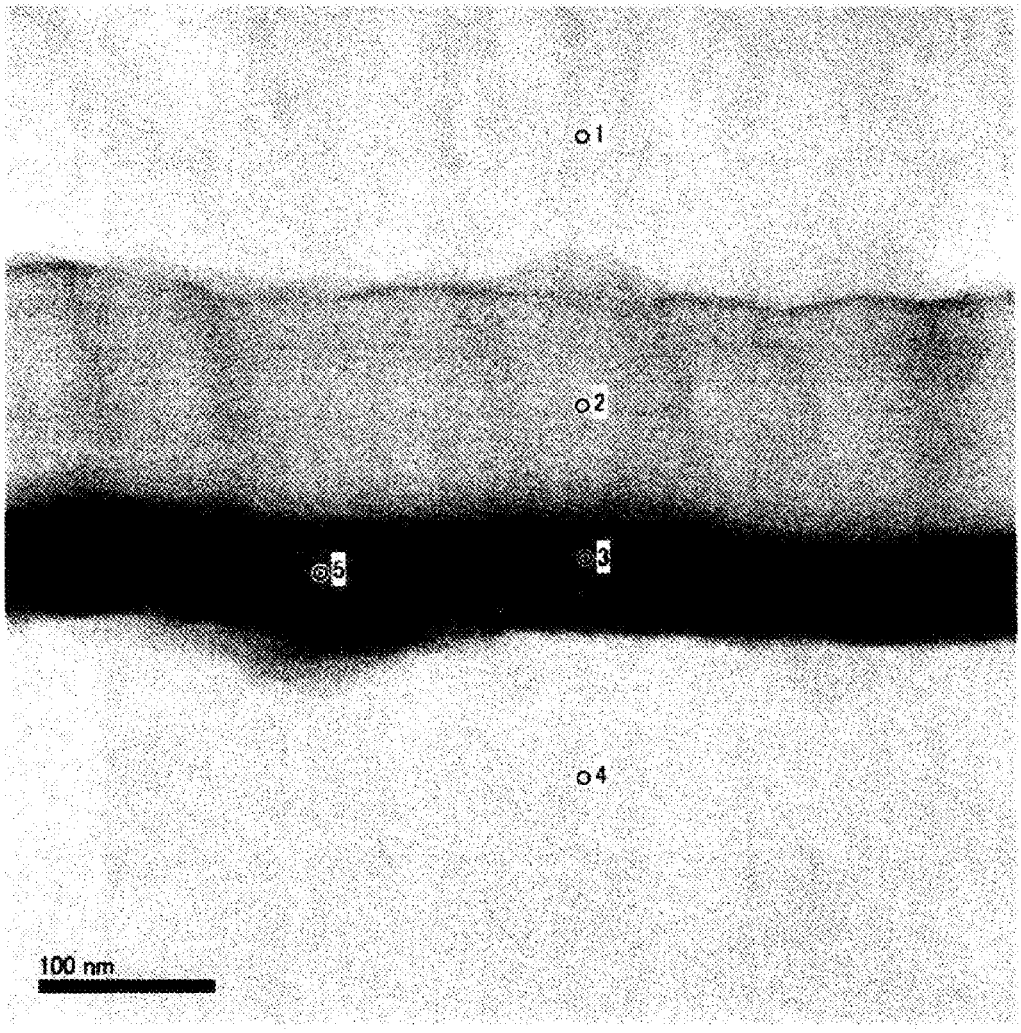
FIG. 1 is a TEM photograph of the cross section of a powder magnetic core according to an embodiment of the present invention observed at 300,000 times.

Hereinafter, a powder magnetic core with terminal according to one embodiment of the present invention and a method for manufacturing the same will be specifically described. However, the present invention is not limited to thereto, and can be appropriately changed within the scope of the technical ideas.

The powder magnetic core with terminal includes a powder magnetic core composed of Fe-based alloy particles including Fe as a main component and an element M (M is at least one of Cr or Al) which is more easily oxidizable than Fe, and at least two terminals formed at an interval on a surface of the powder magnetic core. In the present invention, the element constituting the Fe-based alloy together with Fe can be appropriately selected depending on required magnetic properties and oxide layer forming capability, but one of an FeSiCr alloy, an FeSiAl alloy, an FeAlCr alloy, and an FeAlCrSi alloy and the like including the element M (M is at least one of Cr and Al) which is more easily oxidizable than Fe is preferable.

Al and Cr constituting the Fe-based alloy have a higher affinity with O than Fe has. Therefore, when Fe-based alloy particles are oxidized at high temperature in an oxygen-containing atmosphere or in a water vapor-containing atmosphere, oxides of these non-ferrous metals having a high affinity with O (for example, $Al_2O_3$ and $Cr_2O_3$) are formed on the surface of the Fe-based alloy particles.

Using such a phenomenon, when the Fe-based alloy particles are pressed into a predetermined shape, and the green compact is annealed at a predetermined temperature in a predetermined atmosphere, the oxides of the elements M having a high affinity with oxygen (O) and Fe are formed so as to cover the surface of the Fe-based alloy particles (also referred to as alloy particles). The oxides fill voids between the particles to constitute a grain boundary, thereby bonding the alloy particles and covering the surface of the powder magnetic core. In the present invention, one in a pressed state without a heat treatment is referred to as a green compact, and one in a state where an oxide is formed after a heat treatment is referred to as a powder magnetic core.

An oxide is obtained by reacting Fe-based alloy particles with oxygen by a heat treatment to be grown, and examples thereof include an Fe oxide, an Al oxide, and a Cr oxide formed by an oxidation reaction exceeding the natural oxidation of the Fe-based alloy particles. Hematite ($Fe_2O_3$), wustite (FeO), and magnetite ($Fe_3O_4$) may be included in the oxide formed on the surface of the powder magnetic core in which oxidation is apt to proceed as long as a predetermined breakdown electric field to be described later can be obtained.

In consideration of the influence of the element M on the oxide forming ability and magnetic properties, it is preferable that the Fe-based alloy is represented by a composition formula: aFebAlcCrdSi, and includes at least one of Si, Cr, and Al, wherein, in mass %, a+b+c+d=100, 75≤a<100, 0≤b<13.8, 0≤c≤10, and 0≤d≤5 are set. More preferably, in the composition formula, a+b+c+d=100, 4≤b<13.8, 3≤c≤7, and 0≤d≤1 are set. When Cr is included with Al, Cr also functions to aid the oxidation of Al, and serves to cause the Fe-based alloy particles to be bonded through an Al enriched oxide layer in a heat treatment.

The Fe-based alloy may contain, for example, Mn≤1 part by mass, C≤0.05 parts by mass, Ni≤0.5 parts by mass, N≤0.1 parts by mass, P≤0.02 parts by mass, and S≤0.02 parts by mass as inevitable impurities and the like. The amount of O contained in the alloy is preferably as small as possible, and more preferably 0.5 parts by mass or less. Each composition amount is a value of an additional number when the amount of the main component is taken as 100 parts by mass.

The average particle diameter of the alloy particles (here, a median diameter d50 in cumulative particle diameter distribution is used) is not particularly limited, but by decreasing the average particle diameter, the strength and high frequency characteristics of the core are improved. For example, in applications requiring the high frequency characteristics, the particles having an average particle diameter of 20 μm or less can be suitably used. The median diameter d50 is more preferably 18 μm or less, and still more preferably 16 μm or less.

Meanwhile, when the average particle diameter is small, the specific surface area is large, which facilitates oxidation, so that the median diameter d50 is more preferably 3 μm or more. Coarse particles are more preferably removed from the particles by using a sieve and the like. In this case, it is preferable to use at least alloy particles of less than 32 μm (that is, passing through a sieve having an opening of 32 μm).

The form of the Fe-based alloy particles is not particularly limited, but from the viewpoint of fluidity and the like, it is preferable to use a granular powder typified by an atomized powder as a raw material powder. An atomization method such as gas atomization or water atomization is suitable for preparing an alloy powder which has high malleability and ductility and is hard to be pulverized. The atomization method is also suitable for obtaining a substantially spherical alloy powder.

Hereinafter, a method for manufacturing a core using pressing will be described as an example.

A binder is preferably added to Fe-based alloy particles in order to bind the particles to each other when the particles are pressed to impart a strength to withstand handling after pressing to the green compact. The kind of the binder is not particularly limited, but various organic binders such as polyethylene, polyvinyl alcohol, and an acrylic resin can be used, for example. The organic binder is thermally decomposed by a heat treatment after pressing.

The amount of the binder to be added only needs to be such that the binder can be sufficiently spread between the Fe-based alloy particles to ensure a sufficient green compact strength. Meanwhile, the excessive amount of the binder decreases the density and the strength. From such a viewpoint, the amount of the binder to be added is preferably 0.5 to 3.0 parts by mass based on 100 parts by mass of the alloy particles having an average particle diameter (d50) of 10 μm, for example.

The method for mixing the Fe-based alloy powder with the binder is not particularly limited, and conventionally known mixing methods and mixers can be used. A lubricant such as stearic acid or a stearate is preferably added in order to reduce friction between the powder and a mold during pressing. The total amount of the lubricant and the binder added is preferably 3.5 parts by mass or less.

Next, the resultant mixed powder is pressed to obtain a green compact. The mixed powder obtained by the above procedure is suitably granulated as described above, and is subjected to a pressing step. The granulated mixed powder is pressed into various shapes such as a toroidal shape, a rectangular parallelepiped shape, a cylindrical shape, a drum shape, and a pushpin shape by using a pressing die. The pressing may be room temperature pressing or warm pressing performed during heating such that a binder does not disappear. The pressure during pressing is preferably 0.5 GPa or more. The pressure during pressing is preferably suppressed to 1.8 GPa or less because the mold is more likely to be damaged as the pressure during pressing increases. The pressing method is not limited to the above-described pressing, and sheet-like green compacts obtained by a known sheet pressing method such as a doctor blade method may be stacked, heated, and pressure-bonded.

Next, a heat treatment step of heat-treating the green compact obtained through the pressing step will be described. In order to form an alloy-derived oxide between the alloy particles and on the surface of the core, the green compact is subjected to a heat treatment (high temperature oxidation). Such a heat treatment further allows to alleviate stress distortion introduced by pressing and the like. This oxide is obtained by reacting the alloy particles with oxygen by a heat treatment to be grown, and is formed by an oxidation reaction exceeding the natural oxidation of the alloy. The heat treatment can be performed in an atmosphere in which oxygen is present, such as in the air or in a mixed gas of oxygen and an inert gas. The heat treatment can also be performed in an atmosphere in which water vapor is present, such as in a mixed gas of water vapor and an inert gas. Among them, the heat treatment in the air is simple, which is preferable.

The heat treatment temperature in the heat treatment step only needs to be a temperature at which the above-described oxide and the like is formed. Although depending on the alloy composition, at temperatures exceeding 850° C., the alloy particles begin to sinter together, which also causes increased core loss. Since the oxide formed by the heat treatment is also influenced by the heat treatment temperature, the specific heat treatment temperature is preferably in the range of 650 to 850° C. A holding time in the temperature range is appropriately set depending on the size of the core, the treated amount, the allowable range of characteristic variation and the like, and is set to 0.5 to 3 hours, for example. The heat treatment provides a powder magnetic core having an oxide (underlayer) including the element M formed on the surface of the powder magnetic core.

The thickness of the underlayer thus formed is preferably 50 nm or more. The thickness of the underlayer changes depending on the heat treatment atmosphere (temperature, time, oxygen concentration). If the thickness of the underlayer exceeds 100 nm, the oxide serving as the grain boundary phase is also apt to be thick, which affects magnetic properties, for example, causes decreased magnetic permeability. Therefore, the thickness of the underlayer is preferably 50 nm or more and 100 nm or less.

When a space factor is less than 83%, pits (holes) having a depth of more than 10 μm may occur between the alloy particles on the surface of the powder magnetic core. The space factor is preferably 83% or more. The space factor is a relative density, which is calculated by dividing the density of the powder magnetic core by the true density of the Fe-based alloy.

Figure 2:
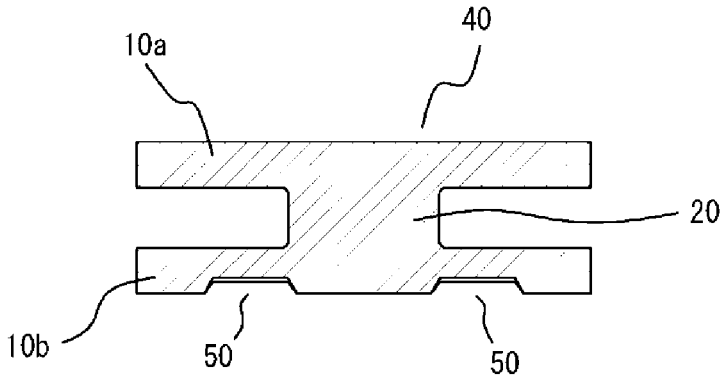
FIG. 2 is a cross-sectional view of a powder magnetic core according to an embodiment of the present invention.

A form of a drum core is shown as an example of a powder magnetic core with terminal. FIG. 2 is a cross-sectional view thereof. An illustrated powder magnetic core with terminal 40 is shaped so as to have flange portions 10*a* and 10*b* at both ends of a columnar body portion 20 around which a conducting wire for a coil is wound. As the form of the drum core, at least one of the flange portions 10*a* and 10*b* has a disk shape and a polygonal plate shape and the like, for example, and the shape is not limited thereto. The shape of the powder magnetic core with terminal of the present invention is also not limited to the shape of the drum core.

In the illustrated powder magnetic core with terminal 40, a terminal 50 is formed in the recessed portion of the end face of the flange portion 10*b*. An oxide (underlayer) derived from the element M (M is at least one of Cr and Al) is formed on the surface of the powder magnetic core. Furthermore, a first layer including at least one of Cr or Al and O and the terminal 50 are sequentially formed on the surface including the region for forming the terminal 50 of the powder magnetic core together with the underlayer. The terminal 50 includes a second layer formed on the surface of the first layer and including one of Au, Ag, Cu, Ti or Cr, and a third layer formed on the surface of the second layer and including one of Ni, Au, Ag or Sn. In FIG. 2, the underlayer and the first layer and the like are not shown.

In the powder magnetic core with terminal of the present invention, the first layer cooperates with the underlayer, whereby the insulation between the terminals 50 formed at an interval can be enhanced. The first layer is preferably composed of a Cr oxide or an Al oxide. Since both the Cr oxide and the Al oxide have high resistance, the insulation between the terminals 50 can be further enhanced. The first layer is composed of an oxide having a crystal lattice constant close to that of the underlayer, whereby the adhesion of the bonded interface is improved, which can provide an increased adhesion strength of the terminal 50.

The first layer can be formed by a sputtering method or a vapor deposition method. Specifically, the surface of the flange portion of the powder magnetic core is covered with a mask except for a portion on which the first layer is formed, and a film can be partially formed on a portion which is not masked, by sputtering a Cr oxide or an Al oxide which is an insulating inorganic material. The first layer may be formed only on a portion on which the terminal is formed, but the first layer is preferably formed on the entire end face including a portion on which the terminal is formed on the surface of the flange portion of the powder magnetic core. This can provide further enhanced insulation between the terminals. A thickness t1 of the first layer is preferably more than 50 nm and 300 nm or less. The thickness t1 of the first layer is more preferably 80 nm or more, and still more preferably 100 nm or more.

The relationship tu<t1 between a thickness tu of the underlayer and the thickness t1 of the first layer is preferably set. By making the first layer thicker than the underlayer, the insulation between the terminals can be enhanced, and by setting the total thickness of the underlayer and the first layer to 150 nm or more, the insulation is further improved.

The second layer is a conductor. The second layer is formed on the surface of the first layer, and includes one of Au, Ag, Cu, Ti or Cr. As with the first layer, the second layer can also be formed by a sputtering method or a vapor deposition method. For example, Au, Ag, Cu, Ti, Cr, or an alloy including them is formed on the surface of the first layer by a sputtering method or a vapor deposition method. It is preferable that the thickness t2 of the second layer is more than the thickness t1, and the relationship among the underlayer, the first layer, and the second layer preferably satisfies to <t1<t2. The thickness t2 of the second layer is preferably 0.1 μm or more in order to enhance the adhesion between the first layer and the third layer. More preferably, the thickness t2 is 0.2 μm or more. Even if the thickness t2 exceeds 1.0 μm, an effect of improving the adhesion is not different so much, whereby the thickness t2 is preferably 1.0 μm or less.

The third layer is also a conductor. The third layer is formed on the surface of the second layer, and includes one of Ni, Au, Ag or Sn. For example, the third layer can be formed on the surface of the second layer according to a plating method, a sputtering method, or a vapor deposition method with Ni, Au, Ag, Sn or an alloy including them. The third layer is preferably formed of a metal or alloy different from that of the second layer in consideration of joining with solder during mounting. A thickness t3 of the third layer is preferably 1.0 μm or more. The thickness t3 of the third layer is more preferably 2.0 μm or more which is thicker than that of the second layer, and still more preferably 6.0 μm or more. In the sputtering method and the like, the increased thickness of the layer to be formed requires a longer time. Therefore, the thickness is preferably set in consideration of productivity. The thickness is preferably 15.0 μm or less. The third layer is preferably obtained by forming a Ni film or a Ni—P film over the second layer, and further forming an Au film, an Sn film, or an Sn—Pb film. A conductor film made of Ni or a Ni—P alloy has a small solubility in molten solder, and functions as a barrier layer for protecting a terminal. A conductor film made of Au, Sn or an Sn—Pb alloy is preferable because it enhances solder wettability. The barrier layer is preferably formed at a thickness of 0.8 μm or more.

In the present invention, the cross section is observed at five places in a different fields of view at 300,000 times according to TEM (Transmission Electron Microscope), and the thickness to of the underlayer and the thickness t1 of the first layer are calculated as an average value of the sums of the maximum and minimum thicknesses in the fields of view. The thickness t2 of the second layer and the thickness t3 of the third layer are similarly calculated from the results of cross-sectional observation at a magnification factor depending on the thickness.

The third layer may be formed by plating the powder magnetic core which is partially activated by the second layer. The plating method may be electrolytic plating or electroless plating, and is not particularly limited. In consideration of the number of plating treatments, the electrolytic plating is preferable.

Figure 3:
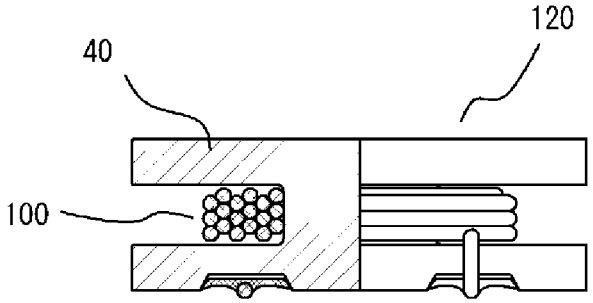
FIG. 3 is a front view including a partial cross section of a coil component using a powder magnetic core according to an embodiment of the present invention.

As in a coil component shown in FIG. 3, a wire is wound around the powder magnetic core with terminal 40 to form a coil 100, and an end portion of the coil 100 is fixed to the terminal 50 by soldering and the like to form a coil component 120. The coil component is used as, for example, a choke, an inductor, a reactor, and a transformer and the like.

EXAMPLES

Example 1

As an Fe-based alloy, an atomized powder was prepared, which had an alloy composition of Fe-5.0% Al-4.0% Cr in mass percentage. The average particle diameter (median diameter D50) of the atomized powder was 10 μm. An acrylic binder was mixed at a ratio of 0.75 parts by mass with respect to 100 parts by mass of the Fe-based alloy particle powder. The mixed powder was dried and sieved to obtain a granulated powder. This granulated powder was pressed at room temperature using a pressing machine at a pressure during pressing of 0.91 GPa. The obtained green compact was heat-treated in the air at 750° C. for 1.0 hour, and then cooled in a furnace to obtain a powder magnetic core. The powder magnetic core was a drum core shown in FIG. 3, and had external dimensions of a length of 1.5 mm, a width of 2.0 mm, and a height of 1.0 mm.

A first layer made of $Cr_2O_3$ was formed in a region having a length of 1.0 mm and a width of 0.7 mm along the direction of a groove portion in a region including the groove portion formed on one end face side of a flange portion by a vapor deposition method. Furthermore, a second layer made of an FeCr alloy was formed over the first layer by a vapor deposition method.

Furthermore, electrolytic plating was performed in a Ni plating bath of a watt bath component. The powder magnetic core was charged together with a dummy metal ball into a barrel container including an electrode for ensuring electrical conduction, immersed in a plating solution, rotated at a speed of 6 rpm, and simultaneously treated at a current density of 0.5 A/dm$^2$ for 120 minutes, to form a Ni plating film (third layer) over the second layer made of the FeCr alloy.

After the formation of the third layer, water washing was performed, and an Sn plating film was then formed over the Ni plating film. Similarly, the powder magnetic core on which the Ni plating film was formed was immersed in a plating solution together with a barrel container, rotated at a speed of 6 rpm, and simultaneously treated at a current density of 0.25 A/dm$^2$ for 120 minutes, to form an Sn plating film. Water washing was performed, followed by drying to obtain a powder magnetic core with terminal of Example.

FIG. 1 is a TEM photograph of the cross section of a powder magnetic core with terminal observed at 300,000 times. A terminal formation region on the surface side of the powder magnetic core with terminal is observed. In FIG. 1, numeral number 4 designates Fe-based alloy particles constituting the powder magnetic core; numeral number 3 designates an underlayer on the surface of the Fe-based alloy particles; numeral number 2 designates a first layer formed over the underlayer; and numeral number 1 designates a second layer formed over the first layer. The numeral numbers 1 to 4 are also points of composition analysis by TEM-EDX (Energy Dispersive X-ray Spectroscopy). In FIG. 1, numeral number 5 designates a point of another composition analysis in the underlayer 3.

According to the TEM observation and the composition analysis by TEM-EDX, in the underlayer 3 on the surface of the Fe-based alloy particles 4, an Al oxide derived from an element M was formed. The bonded interface between the first layer 2 made of $Cr_2O_3$ and the second layer 1 made of an FeCr alloy was bonded without any defect. The first layer 2 and the second layer 1 were formed over the Al oxide as the underlayer 3. From the observation results, the thickness of the underlayer 3 was 81 nm. The thickness of the first layer was 128 nm.

As a result of observing the cross section of the powder magnetic core with terminal at 3000 times, the thickness of the second layer 1 was 2 μm; in the third layer, the thickness of the Ni plating film was 4 μm and the thickness of the Sn plating film was 8 μm. As a result of observation at 80,000 times, the layers were bonded without any defect at the bonded interface.

Comparative Examples 1 and 2

As Comparative Examples, a powder magnetic core produced in the same manner as in Example 1 was used. An Ag film having a thickness of 0.5 μm as a second layer was directly formed on an underlayer on the surface of the powder magnetic core by a vapor deposition method without forming a first layer. Ni plating and Sn plating were performed in the same manner as in Examples, to form a third layer. The thickness of each plated film was also the same as that in Example 1 to obtain a powder magnetic core having a terminal (Comparative Example 1). An Ag paste was printed on the surface of the powder magnetic core, and baked at 650° C. to form a second layer including Ag as a main component and having a film thickness of 6 μm. The second layer was subjected to Ni plating and Sn plating in the same manner as in Example 1 to form a third layer. The thickness of each plated film was also the same as that in Example 1 to obtain a powder magnetic core having a terminal (Comparative Example 2).

The adhesion strength of the terminal was evaluated for the obtained samples of Example 1 and Comparative Examples 1 and 2. The adhesion strength of the terminal is obtained by bonding a pin to the terminal with solder, performing a tensile test, and standardizing a tensile load when the terminal is peeled off with an electrode area. A Kovar pin of φ 0.3 mm×20 mm was connected to the terminal by eutectic solder. This was placed on a fixing jig. The fixing jig was screwed into a tensile tester (Autograph manufactured by Shimadzu Corporation: Model AG-1). The Kovar pin was clamped to a fixing member on a tension side. A tensile test was performed at a load cell of 1 kN and a tensile speed of 0.2 mm/sec, and the tensile load was divided by the area of the terminal (0.7 mm$^2$) to obtain an adhesion strength. The number of samples was five, respectively, and the test was performed on one of two terminals of one sample.

For 5,000 samples of Example 1 and Comparative Examples 1 and 2, DC resistance was measured by using an insulation resistance meter under a condition of applying a voltage of 25 V between the terminals for 1 second to confirm the presence or absence of conduction. A digital super-resistance meter 5451 manufactured by ADC Corporation was used as the insulation resistance meter. The obtained results are shown in Table 1 together with the adhesion strength (average value) of the terminal.

TABLE 1

| | Adhesion strength (N/mm$^2$) | Number of conductions between terminals (number) |
|---|---|---|
| Example 1 | 12.6 | 0 |
| Comparative Example 1 | 11.0 | 1 |
| Comparative Example 2 | 11.3 | 1 |

Example 1 had an adhesion strength higher than that of Comparative Examples 1 and 2, and excellent adhesion of the terminal to the powder magnetic core. In the powder magnetic core with terminal of the present invention, no conduction between the terminals was confirmed. 10000 samples of Example 1 were further added for resistance evaluation, but there was no conduction between the terminals. The formation of the first layer caused the insulation between the terminal and the powder magnetic core to be ensured, and the strong adhesion at the interface with the underlayer provided an improved adhesion strength of the terminal. When conductive samples of Comparative Examples 1 and 2 were observed with an electron microscope (SEM: Scanning Electron Microscope), the extension of plating was confirmed at the corner portion of the flange portion of the powder magnetic core.

Examples 2 and 3

The same Fe-based alloy particle powder as that in Example 1 was used, and pressed under the same conditions. The obtained green compact was heat-treated in the air at 580° C. or 750° C. for 1.0 hour, and then cooled in a furnace to obtain a powder magnetic core. The powder magnetic core had a plate shape and external dimensions of a length of 5.0 mm, a width of 5.0 mm, and a height of 2.0 mm.

A first layer made of $Cr_2O_3$ was formed in a region having a length of 5.0 mm and a width of 1.5 mm on one surface side of the sample by a vapor deposition method. Furthermore, a second layer made of an FeCr alloy was formed over the first layer by a vapor deposition method. Furthermore, a third layer was obtained by forming a Ni film over the second layer by a vapor deposition method and forming an Sn film over the Ni film by a vapor deposition method. A powder magnetic core with terminal by a heat treatment temperature of 580° C. (Example 2) and a powder magnetic core with terminal by a heat treatment temperature of 750° C. (Example 3) were obtained. The distance between the terminals was 2 mm.

Comparative Example 3

A second layer made of an FeCr alloy was directly formed by a vapor deposition method on a product heat-treated at 580° C. without forming a first layer. Furthermore, an Ni film was formed over the second layer by a vapor deposition method, and an Sn film was formed over the Ni film by a vapor deposition method to form a third layer.

Under the heat treatment condition of 580° C. (Example 2 and Comparative Example 3), the thickness of the underlayer was 17 nm. Under the heat treatment condition of 750° C. (Example 3), the thickness of the underlayer was 81 nm. The thickness of the first layer was 119 nm in Example 2, and 126 nm in Example 3. The total thickness of the underlayer and the first layer was 136 nm in Example 2, and 207 nm in Example 3. The thickness of the second layer was 0.5 μm, and the thickness of the third layer was 6 μm.

A probe was placed between the terminals of each of the five samples of Examples 2 and 3 and Comparative Example 3 thus obtained, and a resistance value was measured in 25 V step. The resistance value of $1.0\times10^7\Omega$ was set as a threshold value, and an electric field where the resistance sharply dropped beyond the threshold value was taken as a breakdown electric field. The average breakdown electric field of 150 V/mm or more was evaluated as very good; the average breakdown electric field of 100 V/mm or more and less than 150 V/mm was evaluated as good; the average breakdown electric field of 50 V/mm or more and less than 100 V/mm was evaluated as average; and the average breakdown electric field of less than 50 V/mm was evaluated as poor. If samples with different evaluations were obtained, the lowest evaluation was taken as the evaluation of the sample group. The electric field is calculated by dividing a voltage by a distance between the terminals. The obtained results are shown in Table 2.

TABLE 2

| | Breakdown electric field |
|---|---|
| Example 2 | Good |
| Example 3 | Very good |
| Comparative Example 3 | Average |

In Examples 2 and 3, a more excellent breakdown electric field than that of Comparative Example 3 was obtained. In Example 3 in which the total thickness of the underlayer and the first layer was large, a higher breakdown electric field than that in Example was obtained. Meanwhile, in Comparative Example 3, the insulating electric field in one sample was less than 50 V/mm.

DESCRIPTION OF REFERENCE SIGNS

1 third layer
2 second layer
3 first layer
4 Fe-based alloy particles
10*a*, 10*b* flange portion
20 body portion
40 powder magnetic core with terminal
50 terminal
100 coil
120 coil component

The invention claimed is:

1. A powder magnetic core with terminal comprising:
a powder magnetic core composed of Fe-based alloy particles including Fe and an element M (M is at least one of Cr or Al) which is more easily oxidizable than Fe; and
at least two terminals formed at an interval on a surface of the powder magnetic core,
wherein,
the powder magnetic core includes
the Fe-based alloy particles, and
an underlayer including the element M (M is at least one of Cr or Al), Fe and O formed on a surface of the Fe-based alloy particles;
a first layer consisting essentially of at least one of Cr or Al and O, and the first layer being essentially free of Fe, is formed on a surface including a region in which the terminals of the powder magnetic core are formed;
the terminals are formed on a surface of the first layer; and
each of the terminals includes a second layer including one of Au, Ag, Cu, Ti or Cr.

2. The powder magnetic core with terminal according to claim 1, wherein the terminal further includes a third layer including one of Ni, Au, Ag or Sn formed on a surface of the second layer.

3. The powder magnetic core with terminal of claim 1, wherein a thickness tu of the underlayer, a thickness t1 of the first layer, and a thickness t2 of the second layer have a relationship of $tu<t1<t2$.

4. The powder magnetic core with terminal according to claim 1, wherein the first layer is composed of a Cr oxide or an Al oxide.

5. The powder magnetic core with terminal according to claim 1,
wherein:
the Fe-based alloy includes Fe, Al and Cr;
the underlayer includes Fe, Al, Cr and O; and
the first layer consists essentially of Al or Cr and O.

6. The powder magnetic core with terminal according to claim 1, wherein:

two terminals are formed side by side on one surface of the powder magnetic core; and the underlayer is formed on the entire one surface of the powder magnetic core including at least between the terminals.

7. A method for manufacturing a powder magnetic core with terminal according to claim 1, the method comprising:

producing the powder magnetic core including an underlayer formed on a surface of the Fe-based alloy particles, the underlayer including the element M (M is at least one of Cr or Al), and Fe and O;

forming a first layer consisting essentially of at least one of Cr or Al and O, and the first layer being essentially free of Fe, on a surface including a region in which the terminals of the powder magnetic core are formed; and forming a second layer including one of Au, Ag, Cu, Ti, Fe or Cr on a surface of the first layer, wherein the first layer and the second layer are each formed by a sputtering method or a vapor deposition method.

8. The method for manufacturing a powder magnetic core with terminal of claim 7, further comprising forming a third layer including one of Ni, Au, Ag or Sn on a surface of the second layer.

9. The method for manufacturing a powder magnetic core with terminal according to claim 7, wherein the first layer is composed of a Cr oxide or an Al oxide.

10. The method for manufacturing a powder magnetic core with terminal according to claim 7, further comprising:

pressing a mixed powder including the Fe-based alloy particles into a predetermined shape to obtain a green compact; and heat-treating the green compact obtained by the pressing in an oxygen-containing atmosphere to oxidize the Fe-based alloy particles at high temperature, thereby forming the underlayer on the surface of the Fe-based alloy particles.

11. The method for manufacturing a powder magnetic core with terminal according to claim 7, wherein:

a thickness of the underlayer is 50 nm or more and 100 nm or less;

a thickness of the first layer is more than 50 nm; and a total thickness of the underlayer and the first layer is 150 nm or more.

* * * * *